US006898809B2

(12) United States Patent
Davis

(10) Patent No.: US 6,898,809 B2
(45) Date of Patent: May 31, 2005

(54) AIR MATTRESS WITH SINGLE PERIMETER SEAM

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 0 days.

(21) Appl. No.: 10/638,450

(22) Filed: Aug. 11, 2003

(65) Prior Publication Data

US 2005/0034242 A1 Feb. 17, 2005

(51) Int. Cl.[7] ..... A61G 7/08; A47C 27/08

(52) U.S. Cl. ..... 5/81.1 R; 5/711; 5/732; 5/655.3

(58) Field of Search ..... 5/81.1 R, 706, 5/711–715, 731, 732, 652.1, 652.2, 654, 655.3

(56) References Cited

U.S. PATENT DOCUMENTS

| | | | |
|---|---|---|---|
| 4,272,856 | A | 6/1981 | Wegener et al. |
| 4,517,690 | A | 5/1985 | Wegener |
| 4,627,426 | A | 12/1986 | Wegener et al. |
| 5,065,464 | A | 11/1991 | Blanchard et al. |
| 5,483,709 | A | 1/1996 | Foster et al. |
| RE35,299 | E | 7/1996 | Weedling et al. |
| 5,561,873 | A | 10/1996 | Weedling |
| 5,598,593 | A | 2/1997 | Wolfe |
| 5,742,958 | A | 4/1998 | Solazzo |
| 6,073,291 | A | 6/2000 | Davis |
| 6,374,435 | B1 | 4/2002 | Leininger et al. |
| 6,415,583 | B1 | 7/2002 | Landi et al. |
| 6,418,579 | B2 | 7/2002 | Perez et al. |
| 6,677,026 | B1 * | 1/2004 | Yates ..... 428/137 |
| 2002/0166168 | A1 * | 11/2002 | Weedling et al. ..... 5/81.1 R |

* cited by examiner

*Primary Examiner*—Michael Safavi
(74) *Attorney, Agent, or Firm*—Duane Morris LLP

(57) ABSTRACT

A transfer mattress is provided including a top sheet having a width, a length, and longitudinally oriented peripheral edges and a bottom sheet having the same width, the same length, longitudinally oriented peripheral edges and a plurality of perforations. The longitudinally oriented peripheral edges of the top and bottom sheets are sealingly fastened to one another often by heat sealing. A plurality of baffles, each having a width and a length, are attached to an inner surface of the top sheet and an inner surface of the bottom sheet so as to be transversely oriented between the top sheet and the bottom. The baffles along with the widths of the top and bottom sheets define a radially-outwardly curved perimeter wall that is disposed between an edge of the baffles and the sealed peripheral edges of the top and bottom sheets. The radially-outwardly curved perimeter wall has a width y that is determined by the following relationship:

$$\frac{d\pi - x}{2} \leq y$$

where d comprises a height of the longitudinally extensive pontoon and x comprises the width of the baffles.

7 Claims, 4 Drawing Sheets

AIR MATTRESS WITH SINGLE PERIMETER SEAM

FIELD OF THE INVENTION

The present invention generally relates to patient transfer devices and, more particularly to a patient transfer apparatus which employs an air bearing to facilitate the transfer.

BACKGROUND OF THE INVENTION

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

For example, in U.S. Pat. No. 4,517,690, issued to Wegener, an air pallet is disclosed that is formed from upper and lower thin flexible film sheets sealed at their edges to form a plenum chamber. Wegener's air pallet functions to move a load with minimal friction over an underlying generally planar fixed support surface. The bottom thin flexible material sheet is perforated by small diameter perforations such as pin holes at the load imprint area.

In U.S. Pat. No. 5,561,873, issued to Weedling, provides an inflatable flexible pallet within which an array of structurally interrelated inflatable chambers are formed to support a load when inflated. The flexible pallet is configured to resist lateral and longitudinal shrinkage of the load support surface, as well as ballooning and hot dogging. Rotational instability is also reduced by providing a greater load surface support area.

In U.S. Pat. No. 6,073,291, issued to Davis, an inflatable medical patient transfer apparatus is disclosed that has a combination of transverse partition members and a raised perimeter section to reduce deleterious ballooning and uneven inflation as well as quick emergency deflation. Additional differentially inflatable patient rolling chambers are disclosed on the top of the transfer apparatus to provide assistance to medical personnel in beginning to roll patients reclining or lying upon the transfer apparatus, particularly in a deflated condition on a hospital bed.

All of the foregoing devices have suffered from an inability to be cleaned sufficiently and quickly so as to prevent transmission of disease from their patient engaging surfaces after use. Such a mattress would need to have the material contacting the patient be readily washable, and also be non-absorbent, since patients often experience loss of bodily fluids with resultant messing of bed linen and the like.

One solution to this ongoing problem is provided in U.S. Pat. No. 4,627,426, issued to Wegener et al., which discloses a highly absorbent sheet is provided to be placed onto the top of an operating table, and is weakened longitudinally through the center to form paired separable center-joined sections for lateral removal to respective sides of a patient lying on the sheet and centered longitudinally therewith. Thus after surgery, the absorbent pad carrying a significant mass of blood can be quickly removed from the patient by pulling with sufficient force on the opposites sides of the pad, severing the pad along the weakened portion. The pad may have several layers with one or more layers being weakened by thinning the sheet material or perforating the same longitudinally.

Unfortunately, many of the foregoing devices also suffer from the fact that their uninflated area is significantly larger than their inflated area. Consequently, peripheral edge portions of these devices tend to hang over the peripheral edges of a hospital bed or patient transfer cart, adding to the aforementioned cleaning problems. In the medical field, there is a continuing need to easily, safely and comfortably transport an injured person, hospital patient or injured person at the scene of an accident, using an air mattress. There is also a continuing need to be able to easily and safely clean such a mattress after use.

SUMMARY OF THE INVENTION

The present invention provides a transfer mattress including a top sheet having a width, a length, and longitudinally oriented peripheral edges and a bottom sheet having the same width, the same length, longitudinally oriented peripheral edges and a plurality of perforations. The longitudinally oriented peripheral edges of the top and bottom sheets are sealingly fastened to one another often by heat sealing. A plurality of baffles, each having a width and a length, are attached to an inner surface of the top sheet and an inner surface of the bottom sheet so as to be transversely oriented between the top sheet and the bottom. The baffles along with the widths of the top and bottom sheets define a radially-outwardly curved perimeter wall that is disposed between an edge of the baffles and the sealed peripheral edges of the top and bottom sheets. The radially-outwardly curved longitudinally extensive pontoon has an uninflated width y that is determined by the following relationship:

$$\frac{d\pi - x}{2} \leq y$$

where d comprises a height of the longitudinally extensive pontoon and x comprises the width of the baffles.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
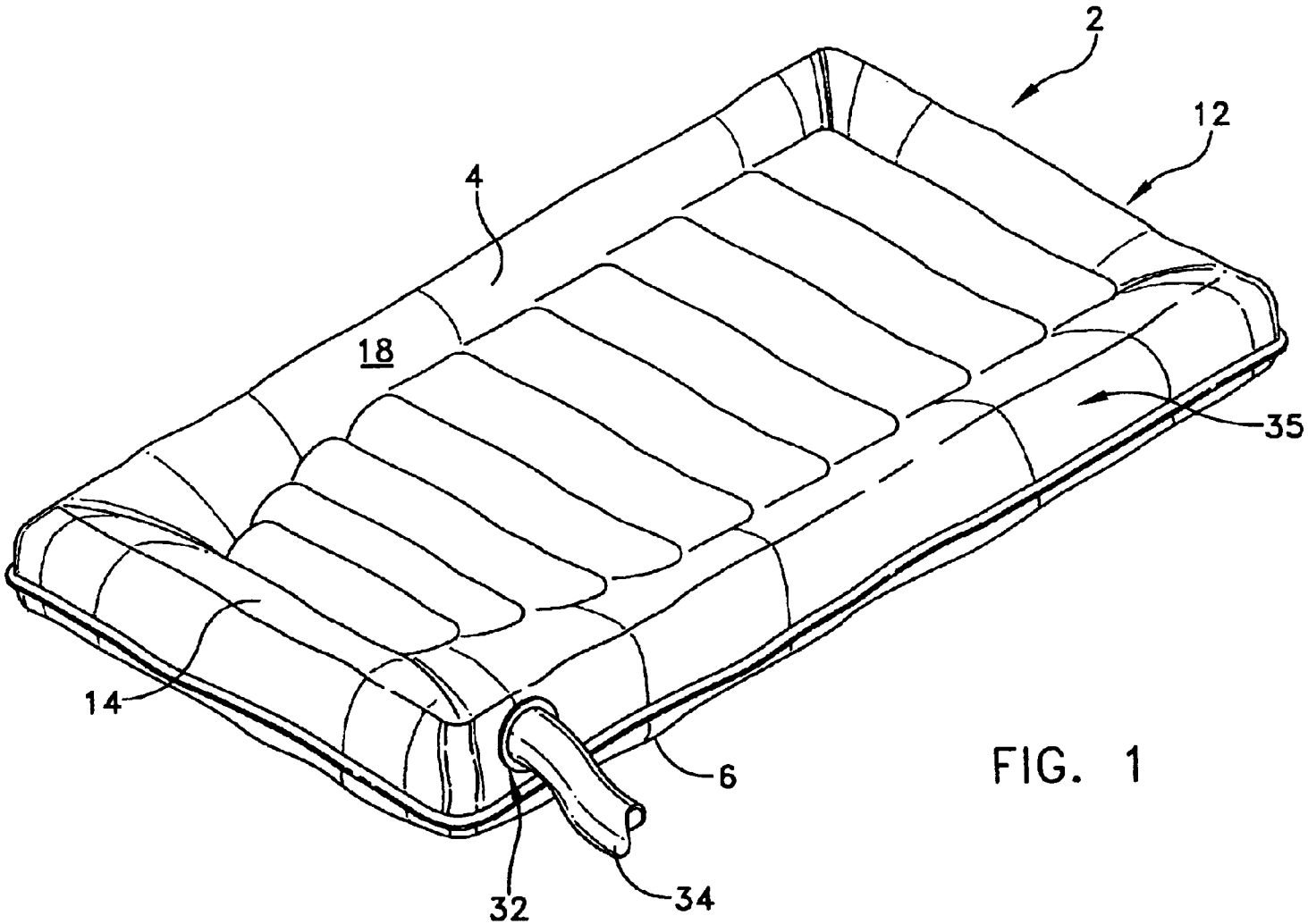
FIG. 1 is a perspective view of a transfer mattress formed in accordance with the present invention.
Figure 2:
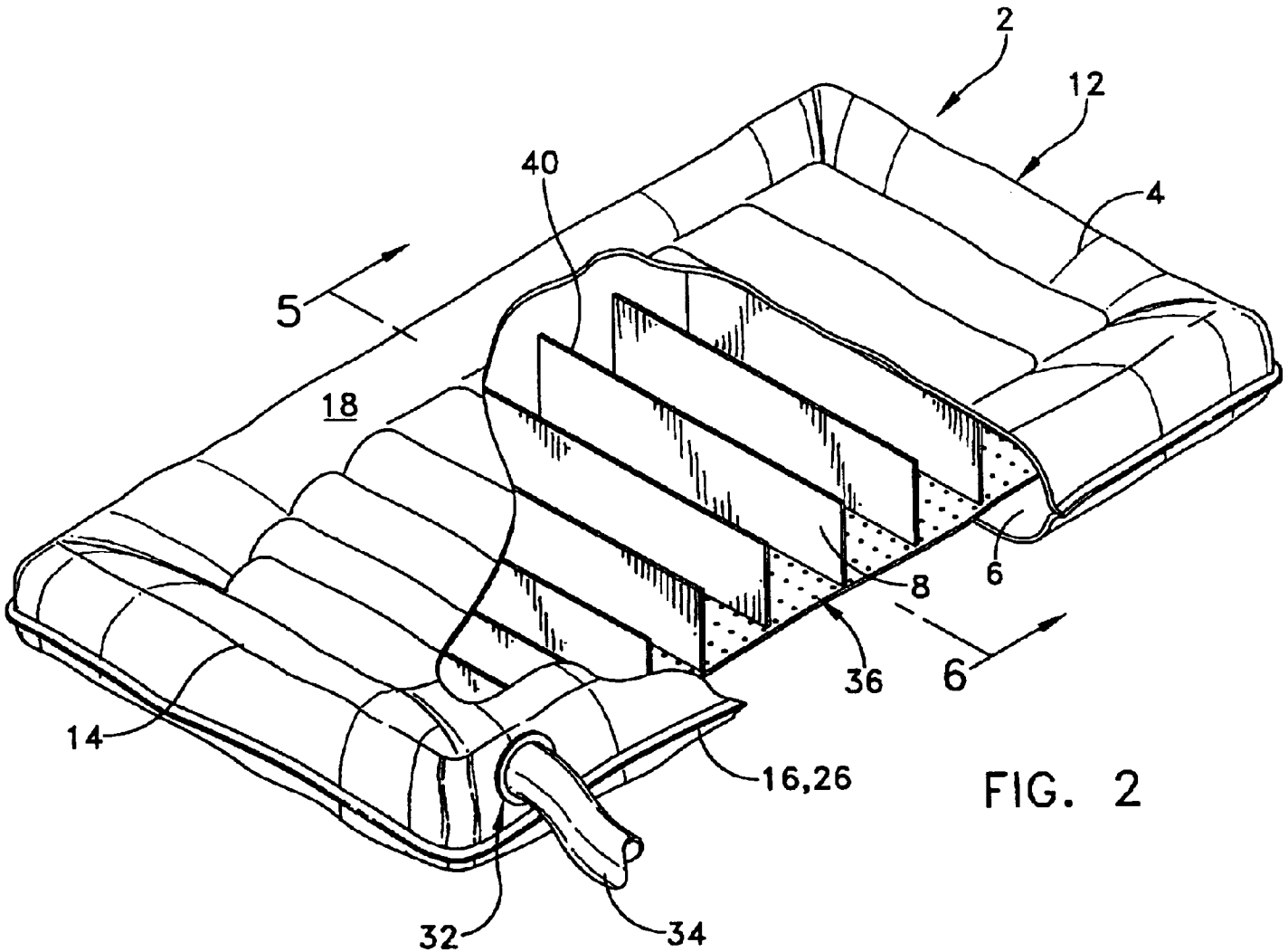
FIG. 2 is a partially broken-way, perspective view of the transfer mattress shown in FIG. 1.
Figure 4:
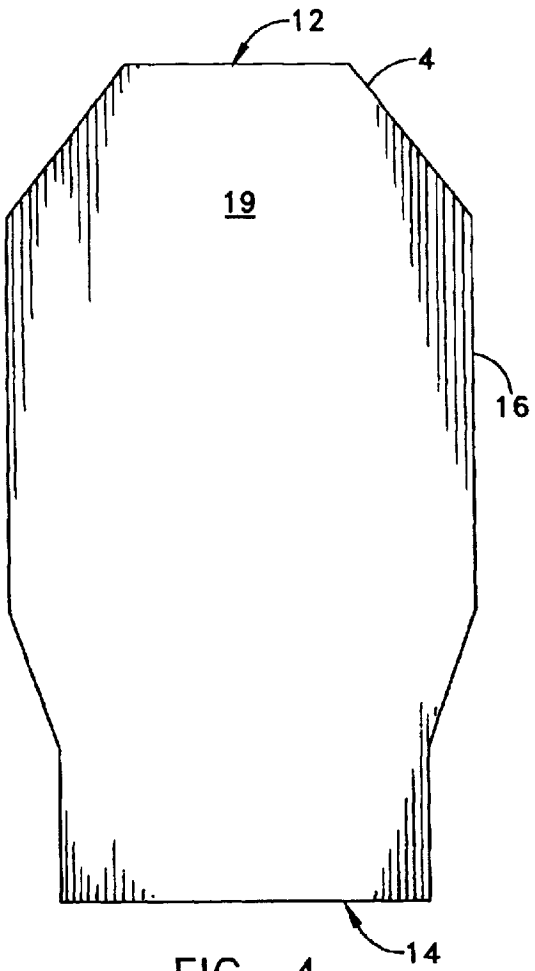
FIG. 4 is a top elevational view of a top panel or sheet formed in accordance with the present invention.
Figure 3:
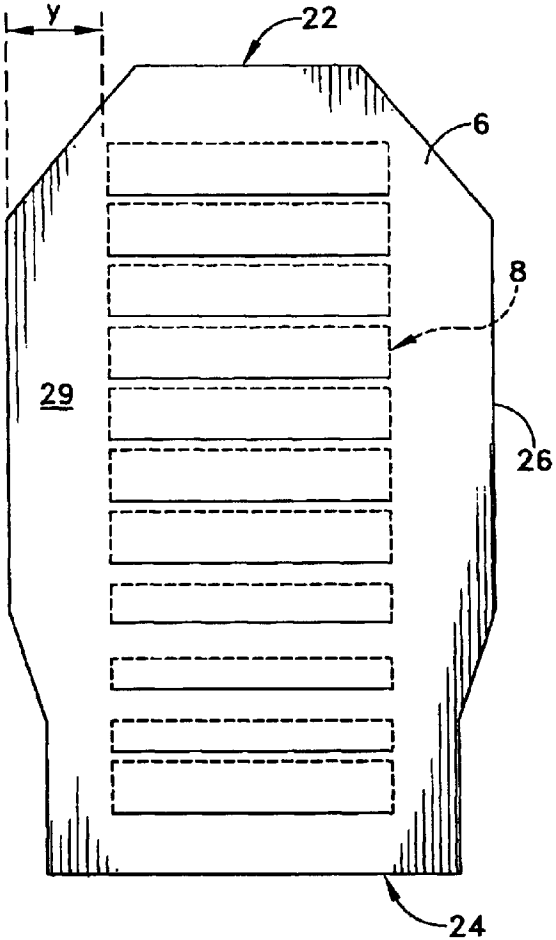
FIG. 3 is a top elevational view of a bottom panel or sheet formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIGS. 1–4, a transfer mattress 2 formed in accordance with the present invention comprises a top panel 4, a bottom panel 6, and a plurality of baffle-panels 8. More particularly, top panel 4 comprises a head portion 12, a foot portion 14, and a peripheral edge 16, and is formed from a sheet of fabric, e.g., nylon scrim or the like, that is coated on at least its outer surface 18 with a water proof coating 20. Inner surface 19 of top panel 4 may also be coated with a water proof coating 20 as well. Water proof coating 20 may be any of the well known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a Durable Water Repellant (Patient side). Alternatively, transfer mattress 2 may be formed from a top panel 4 and a bottom panel 6 comprising double coated nylon twill, having a polyurethane coating on both outer and inner sides of the panels. It has been found that although Durable Water Repellant repels water for a little while, it eventually washes out of the fabric. Even when new, fluid will bead up but then eventually soak into the scrim of the fabric. The double coated polyurethane coating does not allow any absorption, and is therefore much preferred for use in connection with the present invention. Moreover, the presence of polyurethane on the interior surfaces allows for heat sealing, eliminating needle holes.

A practical benefit associated with the use of the foregoing preferred materials is that transfer mattresses 2 retain a better appearance for longer periods of time during use. Double coated transfer mattresses can be easily wiped down and put back into use more quickly. Mattresses formed from a durable water repellant take much longer to dry when wiped down with a germicidal solution. Also, the need to have to send a double coated transfer mattress to the laundry (mostly off site) is greatly reduced. A double coated transfer mattress 2 formed in accordance with the present invention will not soil during normal use. Additionally, because the top side of the mattress is coated with a heat sealable polyurethane, other structures can be attached by heat sealing to the top of the mattress and, advantageously, without sewing.

Bottom panel 6 comprises a head portion 22, a foot portion 24, and a peripheral edge 26, that is also formed from a sheet of nylon scrim or the like, and that may be coated on at least its outer surface 28 with water proof coating 20. Inner surface 29 of bottom panel 6 may also be coated with water proof coating 20 as well. An inlet opening 32 is formed in a corner portion of transfer mattress 2, and may be a closable opening that sealingly accepts an air supply hose 34. Inlet opening 32 is sized and shaped so that air supply hose 34 may be inserted, with the inlet being thereafter snapped shut or otherwise closed to hold air supply hose 34 in place while transfer mattress 2 is being inflated. Inlet opening 32 may also include a valve (not shown) that is biased to be normally closed to prevent air from exiting through the inlet, and opened when air supply hose 34 is inserted into inlet opening 32. Other arrangements known to those skilled in the art may be used to inflate transfer mattress 2.

Bottom panel 6 also includes a plurality of tiny holes 36 that are defined through its thickness to allow air, that is supplied by a low-pressure air supply to transfer mattress 2, via air supply hose 34, to escape in a controlled manner. The air supplied to transfer mattress 2 escapes through plurality of holes 36, providing a weight-bearing cushion of air that facilitates the sliding of transfer mattress 2 along a surface, as well as, from one surface to another.

Plurality of baffle-panels 8 each comprise substantially rectangular sheets of nylon scrim or the like, and include a top edge 40 and a bottom edge 42. Baffle-panels 8 may have differing widths, depending upon their position within transfer mattress 2. Each top edge 40 is fastened transversely to a portion of inner surface 19 of top panel 4, and each bottom edge 42 is fastened transversely to a portion of inner surface 29 of bottom panel 6, as will hereinafter be disclosed in further detail.

A transfer mattress 2 is assembled according to the present invention in the following manner. Bottom panel 6 is laid out on a suitable support surface so that baffle-panel 8 may be transversely arranged in the center section of inner surface 29. Once in this position, bottom edge 42 of each baffle-panel 8 is fixedly fastened to inner surface 29 of bottom panel 6. Baffle-panels 8 are advantageously heat sealed along the interface between bottom edge 42 and inner surface 29 of bottom panel 6. This heat sealing may be done with the application of heat or ultra sonic energy at the edge interface. In this way, a re-solidified interface structure (FIG. 6) is formed between top edge 16 and bottom edge 26 so as to improve the bond and its resistance to rupture under normal loading.

Once plurality of baffle-panels 8 are fastened to inner surface 29 of bottom panel 6, top panel 4 is arranged in overlying confronting relation with bottom panel 6 so that head portion 12 of top panel 4 is confronting head portion 22 of bottom panel 6 and foot portion 14 of top panel 4 is confronting foot portion 24 of bottom panel 6. Once in this position, each top edge 40 of each baffle-panel 8 is fixedly fastened to inner surface 29 of top panel 4.

Figure 5:
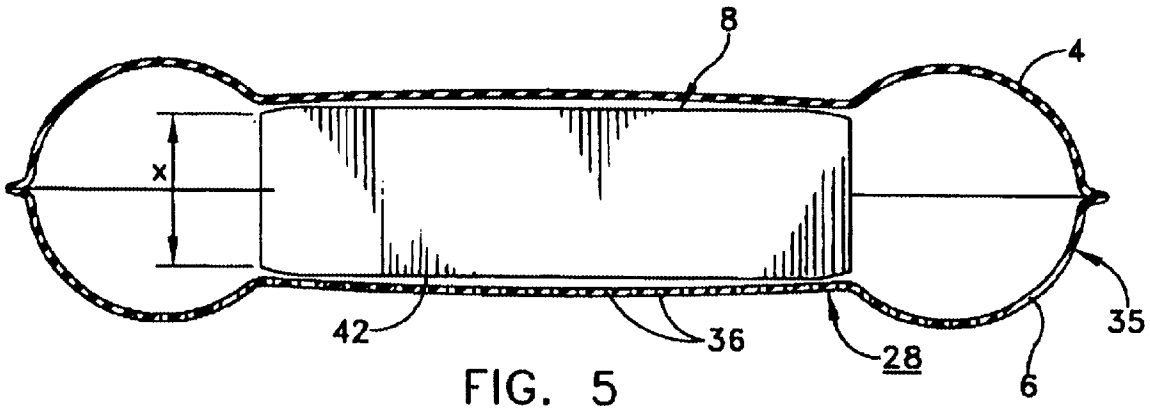
FIG. 5 is a cross-sectional view, as taken along lines 5–6 in FIG. 2, showing a baffle and a dimensional relationship of a radially-outwardly curved perimeter wall to the mattress as a whole.
Figure 6A:
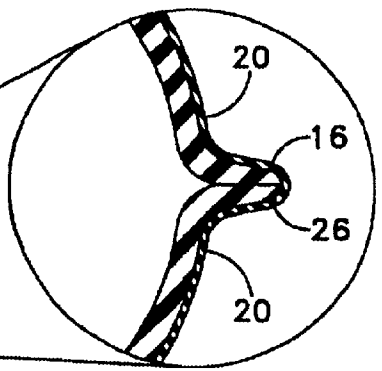
FIGS. 6 and 6A are a broken-away cross-sectional view of the transfer mattress shown in FIGS. 5 and 2, with FIG. 6A showing an enlarged portion so as to illustrate a waterproof coating.
Figure 6:
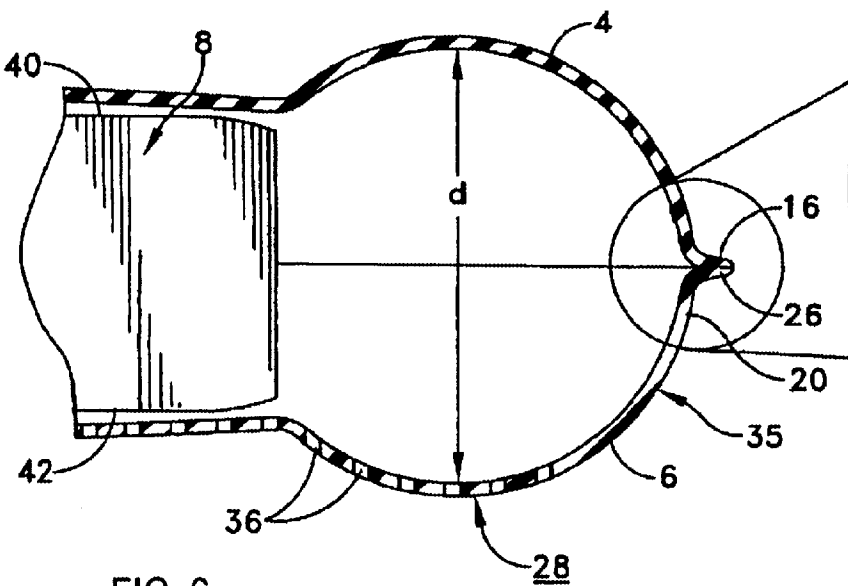

In order to complete construction of transfer mattress 2, it is necessary to sealingly fasten peripheral edge 16 of top panel 4 to peripheral edge 26 of bottom panel 6 (FIGS. 5–6). Significantly, in order to prevent a person from rolling off transfer mattress 2 during sliding, it has been found to be advantageous to create a radially outwardly curved perimeter wall or "pontoons" 35 that extend longitudinally from head portion 22 to foot portion 24 on either side of baffle-panels 8. Pontoons 35 often comprise a substantially cylindrical shape throughout most of their length, with a substantially circular transverse cross-sectional profile. This provides for a "cradling" effect for the patient. A significant improvement in functionality of transfer mattress 2 is achieved, if pontoon 35 is sized according to the following relationship:

$$\frac{d\pi - x}{2} \leq y$$

where y is the uninflated width of top panel 4 and bottom panel 6 as measured from an edge of baffle-panels 8 to peripheral edges, 16, 26; d is the inner diameter of a pontoon 35, i.e., the distance from that portion of top panel 4 that extends from the edge of baffle-panel 8 to peripheral edge 16 and that portion of bottom panel 6 that extends from the edge of baffle-panel 8 to peripheral edge 26, once transfer mattress 2 is inflated; x is the width of a baffle-panel 8; and $\pi$ is the well known geometric/trigonometric constant having an approximate value of 3.14159.

The creation of an appropriately expanded peripheral pontoon 35 adjacent the ends of the transverse baffle-panels 8 provides several advantages. It helps to raise the sides of inflated transfer mattress 2, so as to give the person supported thereon a feeling of security, as well as, actual security in opposing rolling of the person off the inflated device. In addition, the pronounced curvature of pontoon 35 provides for a reduced contact area between mattress 2 and the underlying support surface, so as to reduce drag. A pair of substantially parallel peripheral pontoons 35, located at the ends of transverse baffle-panels 8 provides a slight relative restriction to air passing to the central chambers during inflation, thereby decreasing the tendency of the device to "balloon", i.e., where the load is jacked or raised up so high that it becomes unbalanced on the footprint formed by the central portion of mattress 2. Pontoons 35 also provide for efficient feeding of low-pressure air to all the central chambers defined by baffle-panels 8 at once, effectively encouraging more uniform inflation of those central chambers, even while slightly restricting or slowing down the feeding of air to them. Pontoons 35 also provide enhanced stiffness to the entire transfer mattress, making it easier to handle when inflated. Thus forming pontoon 35 according to this relationship provides for significantly improved sliding movement of transfer mattress 2 during use.

It is to be understood that the present invention is by no means limited only to the particular constructions herein disclosed and shown in the drawings, but also comprises any modifications or equivalents within the scope of the claims.

What is claimed is:

1. A transfer mattress comprising:

a top panel having a width, a length, and longitudinally oriented peripheral edges;

a bottom panel having said width, said length, and longitudinally oriented peripheral edges and a plurality of perforations wherein said longitudinally oriented peripheral edges of said top and bottom panels are sealingly fastened to one another wherein said top and bottom panels are formed from a sheet of a nylon twill fabric that is coated on at least one surface with a durable water repellant coating and on another surface with a polyurethane; and a plurality of baffles each having a width and a length and being attached to an inner surface of said top panel and an inner surface of said bottom panel so as to be transversely oriented between said top panel and said bottom panel, thereby defining a radially outwardly curved longitudinally extensive pontoon disposed between an edge of said baffles and peripheral edges of said top and bottom panels said radially outwardly curved longitudinally extensive perimeter pontoon having a width y that is determined by the following relationship:

$$\frac{d\pi - x}{2} \leq y$$

wherein d comprises a height of said longitudinally extensive pontoon, and x comprises said width of said baffles.

2. A transfer mattress according to claim 1 wherein said plurality of baffles each comprise a substantially rectangular sheet.

3. A transfer mattress according to claim 1 wherein said baffles are fastened transversely to a portion of an inner surface of said top sheet and to a portion of an inner surface of said bottom sheet.

4. A transfer mattress according to claim 1 wherein said longitudinally oriented peripheral edges of said top and bottom sheets are heat sealed along their interface.

5. A transfer mattress according to claim 4 wherein said heat sealing comprises at least one of heat and ultrasonic energy deposited on interfaced longitudinally oriented peripheral edges of said top and bottom sheets so as to form a re-solidified interface structure.

6. A transfer mattress comprising:

a top panel having a width, a length, and longitudinally oriented peripheral edges;

a bottom panel having said width, said length, and longitudinally oriented peripheral edges and a plurality of perforations wherein said longitudinally oriented peripheral edges of said top and bottom panels are sealingly fastened to one another wherein said top and bottom panels are formed from a sheet of fabric that is coated on at least one surface with a fluid proof coating and further wherein at least one of said top and bottom panels are formed from a sheet of double coated nylon twill, having a heat sealable coating on both outer and inner sides of the panels; and a plurality of baffles each having a width and a length and being attached to an inner surface of said top panel and an inner surface of said bottom panel so as to be transversely oriented between said top panel and said bottom panel, thereby defining a radially outwardly curved longitudinally extensive pontoon disposed between an edge of said baffles and peripheral edges of said top and bottom panels said radially outwardly curved longitudinally extensive perimeter pontoon having a width y that is determined by the following relationship:

$$\frac{d\pi - x}{2} \leq y$$

wherein d comprises a height of said longitudinally extensive pontoon, and x comprises said width of said baffles.

7. A transfer mattress according to claim 6 wherein said fluid proof coating comprises at least one of a polymeric and elastomeric compound that is impervious to semi-solids and liquids.

* * * * *